US008196528B2

(12) United States Patent
Jones

(10) Patent No.: US 8,196,528 B2
(45) **Date of Patent: *Jun. 12, 2012**

(54) TABLECLOTH COVERING AND METHOD OF COVERING AND SKIRTING A TABLE

(75) Inventor: Walter Jones, Westwood, NJ (US)

(73) Assignee: SMT Solutions, Inc., Westwood, NJ (US)

( * ) Notice: Subject to any disclaimer, the term of this patent is extended or adjusted under 35 U.S.C. 154(b) by 1299 days.

This patent is subject to a terminal disclaimer.

(21) Appl. No.: 10/767,131

(22) Filed: Jan. 29, 2004

(65) Prior Publication Data

US 2005/0132938 A1 Jun. 23, 2005

Related U.S. Application Data

(60) Provisional application No. 60/532,121, filed on Dec. 23, 2003.

(51) Int. Cl.
*A47B 13/08* (2006.01)

(52) U.S. Cl. ..... 108/90

(58) Field of Classification Search ..... 108/90; 150/156, 154, 158

See application file for complete search history.

(56) References Cited

U.S. PATENT DOCUMENTS

| | | | | |
|---|---|---|---|---|
| 1,535,895 | A * | 4/1925 | Blackmore | 108/90 |
| 1,587,387 | A * | 6/1926 | Lichtman | 108/90 |
| 1,708,318 | A | 4/1929 | Little | 273/309 |
| 1,856,799 | A * | 5/1932 | Waters | 108/90 |
| 1,916,435 | A | 7/1933 | Ott, et al. | |
| 1,923,429 | A * | 8/1933 | Ericson | 261/34.2 |
| 1,926,429 | A | 9/1933 | Bendelardi | 108/90 |
| 2,283,828 | A * | 5/1942 | Strombach | 108/90 |
| 2,586,153 | A * | 2/1952 | Eisman | 108/90 |
| 2,637,136 | A | 5/1953 | Mark | 108/90 |
| 2,772,886 | A | 12/1956 | Parmele | 273/309 |
| 2,809,466 | A * | 10/1957 | Glover | 108/90 |
| 2,954,635 | A * | 10/1960 | Stotter | 108/90 |
| 3,010,639 | A | 11/1961 | Govatsos | |
| 3,156,280 | A | 11/1964 | Affholter | |
| 3,295,577 | A * | 1/1967 | Danielson | 108/90 |
| 3,310,091 | A | 3/1967 | Geisen et al. | 108/90 |
| 3,368,601 | A | 2/1968 | Gantert-Merz | 150/52 |
| 3,454,969 | A | 7/1969 | Lundberg | 5/487 |
| 3,557,856 | A * | 1/1971 | Berman | 108/90 |

(Continued)

FOREIGN PATENT DOCUMENTS

EP 1 522 239 4/2005

(Continued)

OTHER PUBLICATIONS

MSRKO by Carlisle, We Serve Solutions Catalog, Jun. 2001, 62 pages.

(Continued)

*Primary Examiner* — Jose V Chen

(74) *Attorney, Agent, or Firm* — St. Onge Steward Johnston & Reens LLC

(57) ABSTRACT

Fitted tablecloth covering may be affixed to a table for use in trade shows without the use of a tool or affixing devices. A tablecloth may conveniently and quickly be affixed to a table and provide an appealing visual presentation that does not require the use of installation tools and that will not damage the table.

27 Claims, 14 Drawing Sheets

U.S. PATENT DOCUMENTS

| | | | | |
|---|---|---|---|---|
| 3,580,770 | A | 5/1971 | Dyal | 156/216 |
| 3,703,201 | A | 11/1972 | Musyt et al. | 150/0.5 |
| 3,738,405 | A | 6/1973 | Ericson | 150/52 R |
| 3,739,408 | A | 6/1973 | Pagels | 5/334 |
| 3,916,783 | A | 11/1975 | Filsinger et al. | |
| 3,959,854 | A | 6/1976 | Lewis | 24/84 |
| 4,095,300 | A | 6/1978 | Ruben | 5/334 |
| 4,144,602 | A | 3/1979 | Fernandes | 5/334 |
| 4,596,618 | A | 6/1986 | Hammond | 156/164 |
| 4,698,117 | A | 10/1987 | Enison | 156/486 |
| 4,705,084 | A | 11/1987 | Rodebaugh et al. | 150/52 R |
| 4,708,183 | A | 11/1987 | Figueroa | 150/52 |
| 4,750,402 | A * | 6/1988 | Markey | 108/90 |
| 4,766,301 | A | 8/1988 | Evers | |
| 4,773,961 | A | 9/1988 | Glorioso | 156/361 |
| 4,777,992 | A * | 10/1988 | Olger | 108/90 |
| 4,801,482 | A | 1/1989 | Goggans et al. | |
| 4,823,957 | A | 4/1989 | Skeirik | 206/557 |
| 4,883,001 | A | 11/1989 | Roth | 108/90 |
| 5,069,554 | A | 12/1991 | Bonnett | 383/4 |
| 5,084,321 | A | 1/1992 | Sui | 428/80 |
| 5,232,606 | A | 8/1993 | Leidner | |
| 5,240,758 | A | 8/1993 | Honigberg | 428/100 |
| 5,284,099 | A | 2/1994 | Cohen | 108/90 |
| 5,287,614 | A | 2/1994 | Ehrlich | 29/450 |
| 5,436,053 | A | 7/1995 | Herum | 428/128 |
| 5,443,020 | A | 8/1995 | Price | |
| 5,452,729 | A | 9/1995 | Bergsbaken et al. | 128/849 |
| 5,506,019 | A | 4/1996 | Abeyta et al. | 428/57 |
| 5,609,933 | A * | 3/1997 | Stepanek | 108/90 |
| 5,778,802 | A | 7/1998 | Hairston et al. | 108/90 |
| 5,908,681 | A | 6/1999 | Foster | 428/99 |
| 6,116,167 | A | 9/2000 | Rabe | 108/90 |
| 6,334,399 | B1 | 1/2002 | Kelldorf | 108/90 |
| 6,431,089 | B1 * | 8/2002 | O'Brien | 108/90 |
| 6,499,411 | B2 * | 12/2002 | Brown | 108/90 |
| 6,508,183 | B2 * | 1/2003 | Kerrigan | 108/90 |
| 6,723,668 | B2 | 4/2004 | Principe | 442/316 |
| 6,968,582 | B1 | 11/2005 | Barton et al. | 5/486 |
| 7,178,470 | B2 | 2/2007 | Edinger et al. | 108/90 |
| 2002/0043186 | A1 | 4/2002 | Kelldorf | 108/93 |
| 2003/0208836 | A1 | 11/2003 | Bankemper | 4/245.1 |
| 2004/0028853 | A1 | 2/2004 | Jackson | 428/35.5 |
| 2005/0132938 | A1 | 6/2005 | Jones | 108/90 |

FOREIGN PATENT DOCUMENTS

| | | |
|---|---|---|
| FR | 2 773 313 | 7/1999 |
| GB | 862179 | 3/1961 |

OTHER PUBLICATIONS

AMERICO Inc. "How to Measure" http://web.archive.org/web/20010206033340/americo-inc.com/how.htm Mar. 2, 2007, 10 pages.

* cited by examiner

TABLECLOTH COVERING AND METHOD OF COVERING AND SKIRTING A TABLE

RELATED APPLICATIONS

This patent application claims the benefit of, under Title 35, United States Code, Section 119(e), U.S. Provisional Patent Application No. 60/532,121, filed Dec. 23, 2003.

FIELD OF THE INVENTION

The invention relates to the field of tablecloth coverings and more particularly, to fitted tablecloth coverings that may be affixed to a table, and a method of covering and skirting a table.

BACKGROUND OF THE INVENTION

Tables used in for instance, trade shows have been utilized for many years. The tables typically have several standard sizes. The visual appeal of the presentation is closely related to the success of the product being advertised.

However, these tables are typically used many times over leading to wear and tear. Therefore, these tables used for trade shows generally require a covering to be placed over the top surface and partially down the side of the table in order to dress up the table and to better present the product being advertised.

Referring to FIGS. 1 and 2, the current industry way of topping trade show tables 10 is utilizing a white vinyl material 12 that comes on, for instance, rolls 14, that is then cut by hand using scissors 16 to fit the approximate size of the table and then is stapled to the side of the table 10 using an industrial staple gun 18. A fabric skirt is then attached to the edge of the table, also by stapling. This approach has many drawbacks.

For instance, because the material 12 comes on a roll 14 and is manually cut to size, it is generally cut much larger than needed and sometimes under cut, therefore creating wasted material.

Another problem is that current installation of the vinyl to the tabletop is to staple the material 12 directly to the sides of the table 10. The staples 20 damage the wood upon insertion and when the vinyl 12 is removed after the show; it is torn off leaving the staples 20 in the table. This greatly reduces the life span of the table as well as many wasted man hours removing the staples 20 by hand using a staple removal tool 22 (see FIG. 3).

Still another problem is that as the staples 20 accumulate on the side of the table 10, it becomes increasing difficult to install the vinyl top and skirting. Also, as the tables 10 are removed as well as brought to the events they are placed on table dollies (not shown). During this procedure it is very common for equipment handlers to become injured from protruding staples. In addition, during such events, exhibitors themselves and attendees can become injured as well as clothing and trade show materials can become damaged from protruding un-removed staples.

Finally, the current installation procedure is time consuming with the vinyl material 12 coming on 50 pound rolls 14 making it cumbersome to handle.

SUMMARY OF THE INVENTION

What is desired then is an apparatus and method that will address the aforementioned problems.

Accordingly, it is an object of the present invention to provide a tablecloth that may conveniently and quickly be affixed to a table and to provide an appealing visual presentation.

This and other objects of the invention are achieved by providing a tablecloth that is pre-sized according to standard table dimensions.

Some of the benefits to use of the present invention include for instance, there is no wasted material because the tablecloth is pre-cut to the correct size.

In addition, the installation and removal of the tablecloth take very little time and pre-made tablecloths allow for a more exact piece count when, for instance, shipping to a show site.

According to one aspect of the present invention, a table cover for covering a tabletop, comprises: a top cover for covering a top surface of a tabletop, the top cover having a generally polygonal contour with a plurality of sides at its outer periphery thereof; and, a plurality of side drops, each extending outwards from the respective one of the sides of the top cover, each of two adjacent ones of the side drops defining an adjoining corner with a first drop fold area and a second drop fold area configured to fold for binding the respective adjoining corner of the side drops with an adjacent side drop of the plurality of side drops. The first and second drop fold areas are preferably symmetrical to each other, configured to fold and bind by binding agents, sewing, application of heat, or other known binding methods. The table cover is useful, in particular, as a trade show tablecloth. The table cover is preferably formed of a resilient material such as vinyl, and the top cover can be made to a dimension a little shorter than that of the tabletop and is applicable to cover the tabletop by stretching it.

According to another aspect of the present invention, a table cover for covering a tabletop, comprises: a top cover for covering a top surface of a tabletop, the top cover formed of a resilient material and sized a little smaller than the top surface of the tabletop, the top cover including a plurality of sides at its outer periphery thereof; and, a plurality of side drops formed of a resilient material, each of the side drops extending outwards from the respective one of the sides of the top cover, each of two adjacent ones of the side drops defining an adjoining corner, each of the adjoining corners being folded and bound respectively to an adjacent side drop of the plurality of side drops.

According to another aspect of the present invention, a covered table comprises a tabletop covered with a resilient table cover, the table cover having a top cover and a plurality of side drop portions extending from the top cover, each of two adjacent side drop portions defining an adjoining corner area there-between, the adjoining corner areas each being folded and bound to at least one of two adjacent side drop portions of the table cover, thereby forming a plurality of fitted corners of the table cover. The covered table preferably includes a skirt attached around the sides of the tabletop on top of the fitted sides of the table cover. The skirt can be formed of a fabric material and attached to the tabletop by applying a plurality of staples, tacks, or pins.

According to another aspect of the present invention, a method of making a table cover for covering a tabletop, comprises: providing a table cover formed of a resilient material and having a top cover and a plurality of side drop portions, the top cover being sized a little smaller than the top surface of the tabletop, the side drop portions including a plurality of adjoining corner areas between two adjacent side drop portions, each of the corner area including a first drop fold area and a second drop fold area; folding each of the adjoining corner areas about the first and second drop fold areas; and, binding each of the folded adjoining corner areas with adjacent side drop portions of the table cover so as to make the side drop portions drawn in a generally vertical direction when the table cover is placed over the tabletop.

According to still another aspect of the present invention, a method of placing a table cover over a tabletop, comprising: providing a table cover formed of a resilient material and having a top cover and a plurality of side drop portions, the top cover being sized a little smaller than the top surface of the tabletop, the side drop portions including an adjoining corner area between two adjacent side drop portions, each of the corner area including a first drop fold area and a second drop fold area, the adjoining corner area being folded and bound to at least one of the two adjacent side drop portions of the table cover, thereby forming a plurality of fitted corners of the table cover; locking at least two of the fitted corners of the table cover onto corresponding corners of the tabletop; pulling and stretching the table cover across over opposite corners of the tabletop; and, locking the rest of the fitted corners of the table cover onto corresponding corners of the tabletop.

According to a further aspect of the present invention, a method of applying table coverings onto a table, the table having a tabletop, the method comprises: providing a table cover formed of a resilient material and having a top cover and a plurality of side drop portions, the top cover being sized a little smaller than the top surface of the tabletop, the side drop portions including an adjoining corner area between two adjacent side drop portions, each of the corner area including a first drop fold area and a second drop fold area, the adjoining corner area being folded and bound to at least one of the two adjacent side drop portions of the table cover, thereby forming a plurality of fitted corners of the table cover; locking at least two of the fitted corners of the table cover onto corresponding corners of the tabletop; pulling and stretching the table cover across over opposite corners of the tabletop; locking the rest of the fitted corners of the table cover onto corresponding corners of the tabletop; providing a skirt formed of a fabric material and dimensioned to cover side areas of the table; and, attaching the skirt around the tabletop on top of the fitted sides of the table cover.

The invention and its particular features and advantages will become more apparent form the following detailed description considered with reference to the accompanying drawings.

DETAILED DESCRIPTION OF THE DRAWINGS

Figure 5:
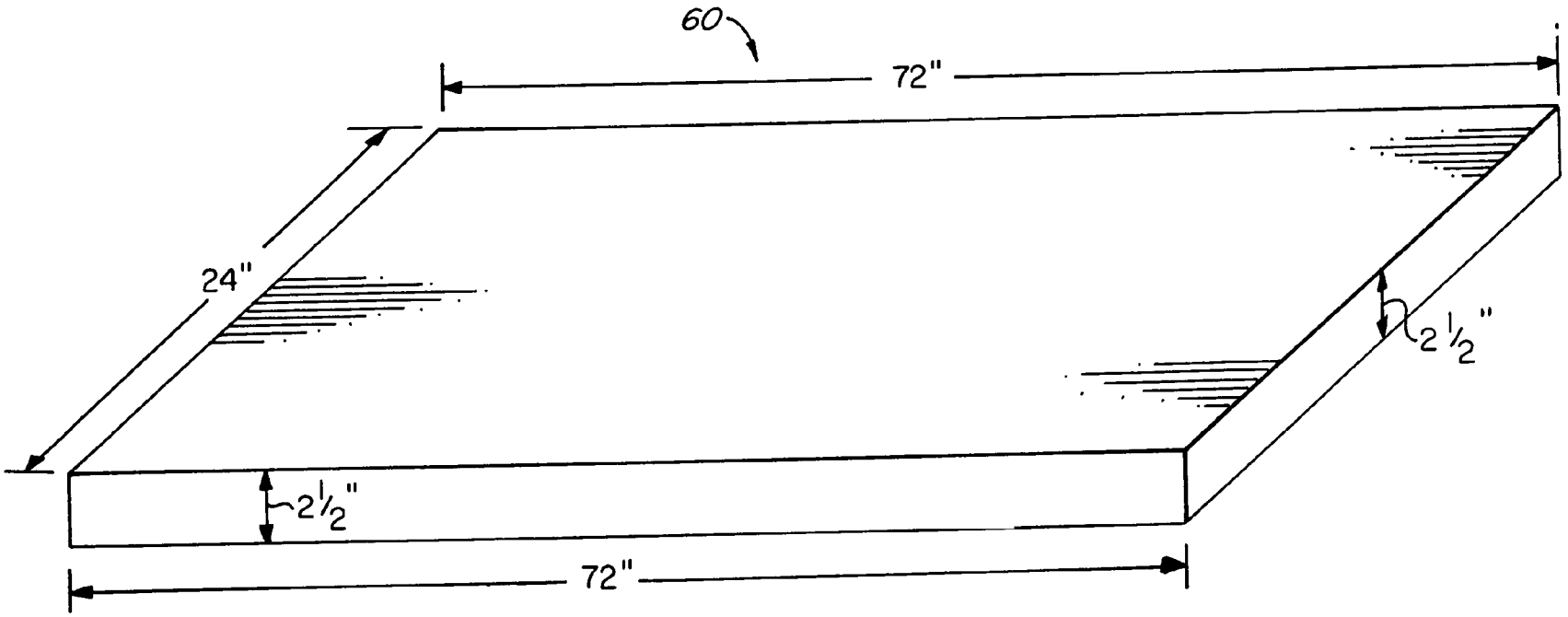
FIG. 5 is a perspective view of a typical table top showing dimensions of surfaces to be covered by the tablecloth.
Figure 6:
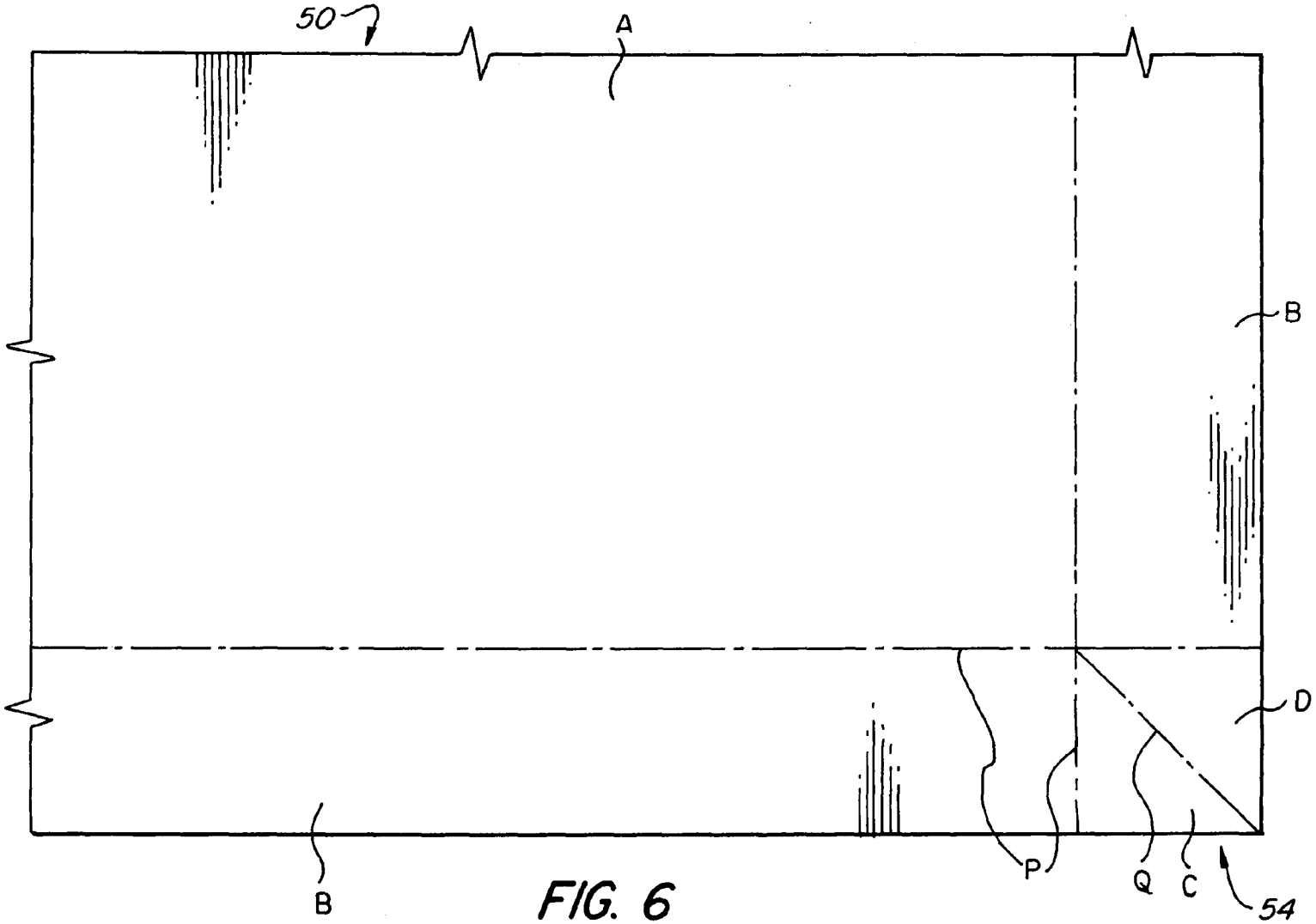
FIG. 6 is a partial top view of one preferred embodiment of the present invention.

In one preferred embodiment of the present invention, a custom fitted, slip over tablecloth is provided that installs onto, for example, trade show tables with a non-intrusive application. With reference to FIG. 6, a tablecloth 50 includes a top cover "A" for covering the top surface of a tabletop 60 (FIGS. 4-5), and a plurality of (e.g., four) side drop portions "B" extending outwards from the top cover "A". The tablecloth material is precut to size to accommodate the existing size tables that are offered, or any other size tables for applying thereon. Existing size tables are typically 24"×48", 24"×72" and 24"×96" and having a 2½" drop on all sides. In a trade show, for example, the site may accommodate many tables of different dimensions. For applying the tablecloths of the invention to these tables, the exact number of the tablecloths 50 can be cut to the corresponding sizes and shipped to the show site. As such, many tablecloths 50 can be cut in advance to cover the existing tables of one or many different dimensions. FIG. 5 illustrates a typical dimension of a conventional six foot table.

The present invention, however, is not intended to be limited to any particular sizes and configurations of such tabletops. For example, the tablecloth of the invention is also applicable to any custom made tabletops with a wide variety of different sizes. It is also applicable to a tabletop having a rectangular, hexagonal, or other polygonal configuration.

Tablecloths 50 is preferably formed of a thin resilient material such as a thin vinyl. For example, thin (e.g., about 4 mm thick) taffeta can be used for the material. Various polymers, or resilient fabric materials may also be used. However, tablecloth 50 can be formed of a substantially non-resilient material. Tablecloth 50 may be transparent, white, colored, or include suitable decorations or pictures thereon.

The top cover "A" of the tablecloth 50 is sized a little shorter than the actual dimension of the tabletop 60 so the resilient material may be stretched to fit tightly onto the tabletop 60. The side drops "B" of the tablecloth 50 is preferably a little wider than the drop size of the table 60 to sufficiently cover thereover. For example, in order to apply onto the conventional size tabletops with two and a half inch drops (see FIG. 5), thin vinyl material is cut into a rectangular shaped table cover 50 with the central top-cover portion "A" dimensioned about one (1) or one half (½) inch shorter than the size of the tabletop and the side drops 52 dimensioned to be about three inch wide. Typical dimensions of the top-cover portion "A" are as follows (when using 4 mm-thick taffeta):

For four-foot (48") tabletop: 47.5" long;

For six-foot (72") tabletop: 71.5" long;

For eight-foot (96") tabletop: 95" long; and

Where, the width of the top-cover portion "A" is made to be the same as that of the tabletop (i.e., 24").

Alternatively, if the tablecloth 50 is formed of a substantially non-resilient material as discussed above, the top cover "A" of the tablecloth is sized to be the same or a little bigger than the actual dimension of the tabletop to slip onto the tabletop. Then, the fitted tablecloth formed in accordance with the description below, may include an elasticized portion particularly along the end sides of the tablecloth to secure the formed tablecloth onto the tabletop. For example, elastic materials such as rubber strings may be attached along the edges of the tablecloth resembling conventional bed sheets.

According to one preferred embodiment of the present invention as described herein below, four corners of the tablecloth 50 are now suitably folded and then bound with respective adjacent side drops 52 of the tablecloth 50 in order to provide a custom "fitted" cover applicable over the tabletop 60.

Figure 7:
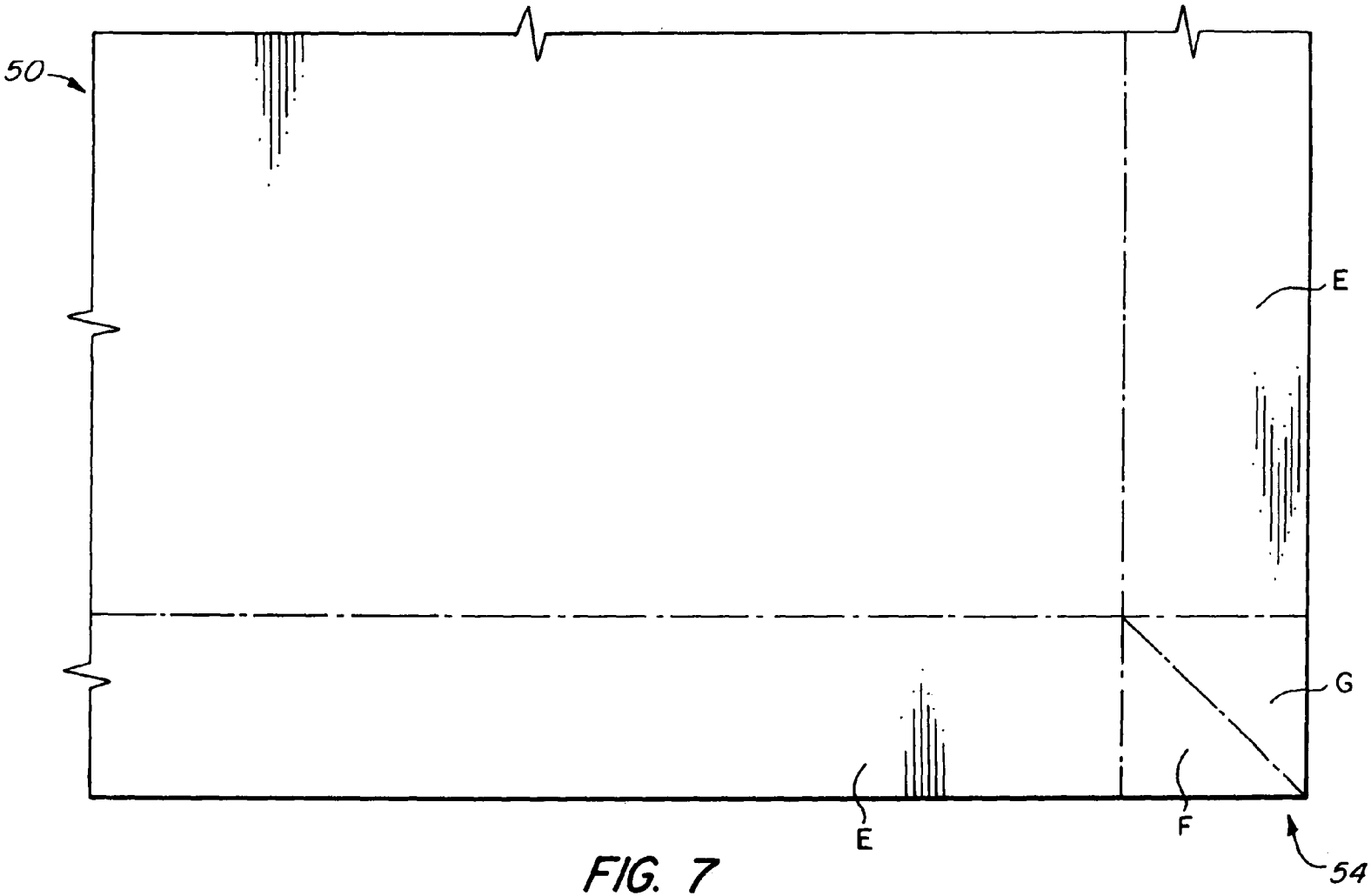
FIG. 7 is a partial bottom view of one preferred embodiment of the present invention according to FIG. 6.
Figure 8:
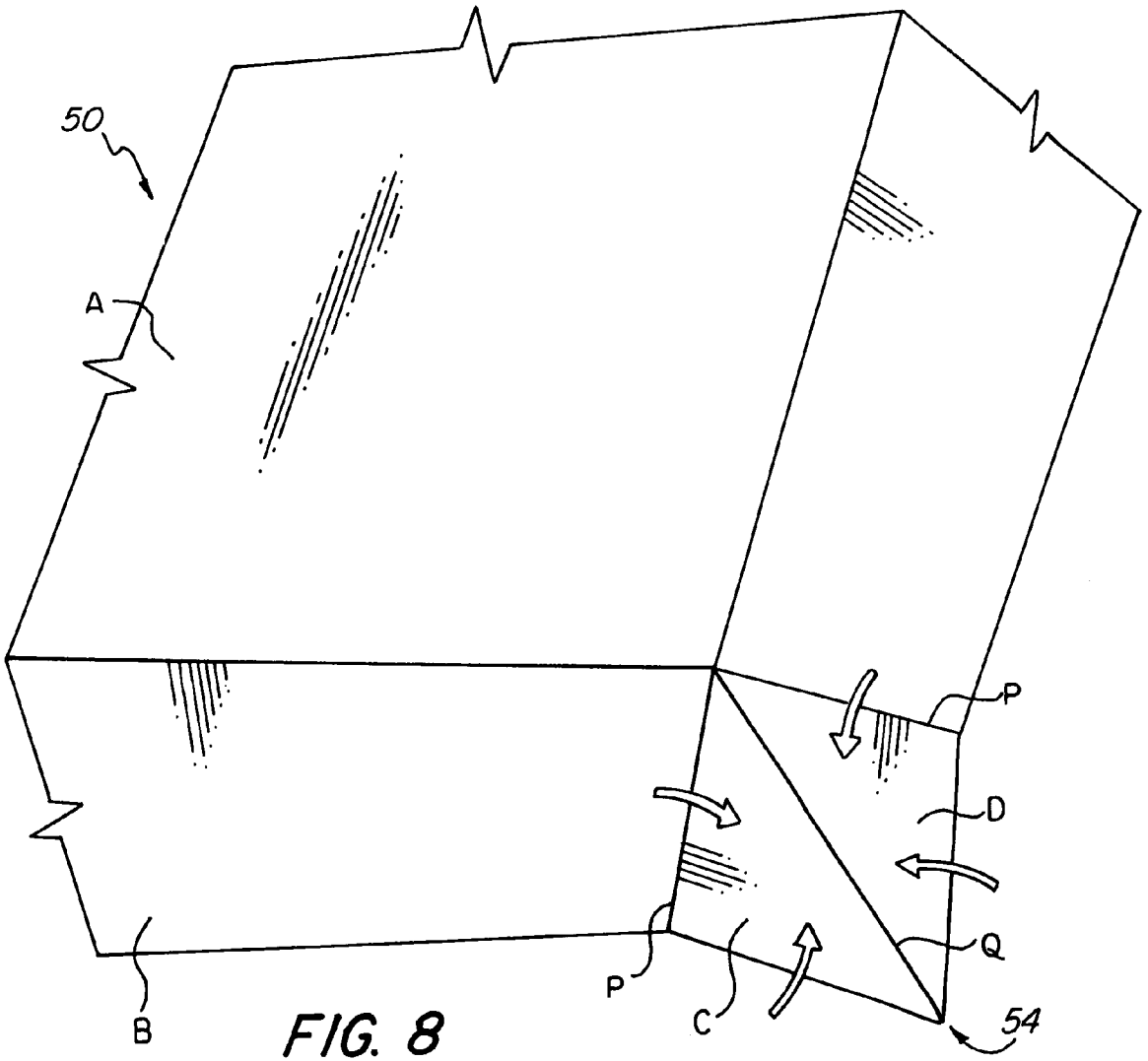
FIG. 8 is a partial top view of the tablecloth according to FIG. 6 showing a folding of a corner.
Figure 9:
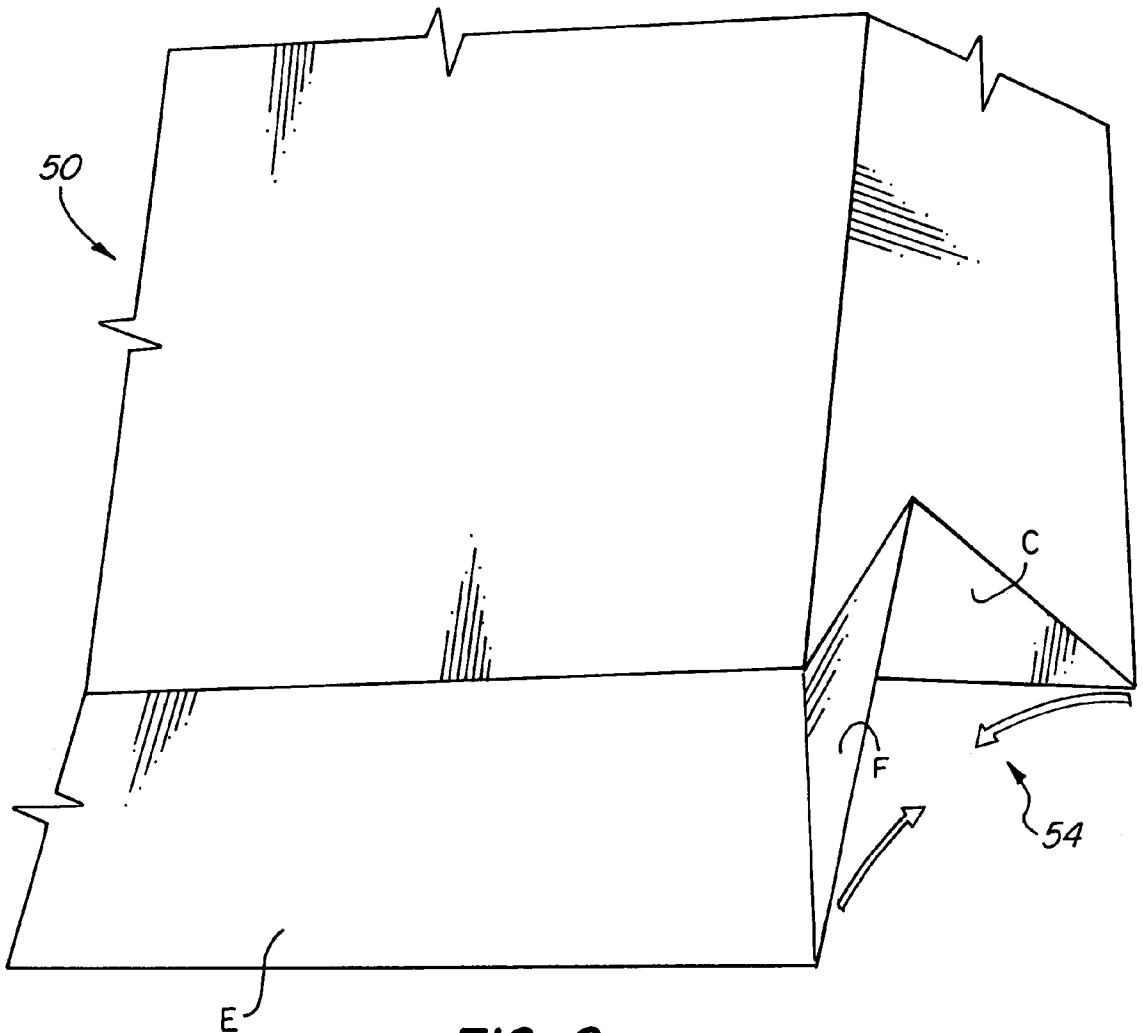
FIG. 9 is a partial bottom view of the tablecloth according to FIG. 8.
Figure 10:
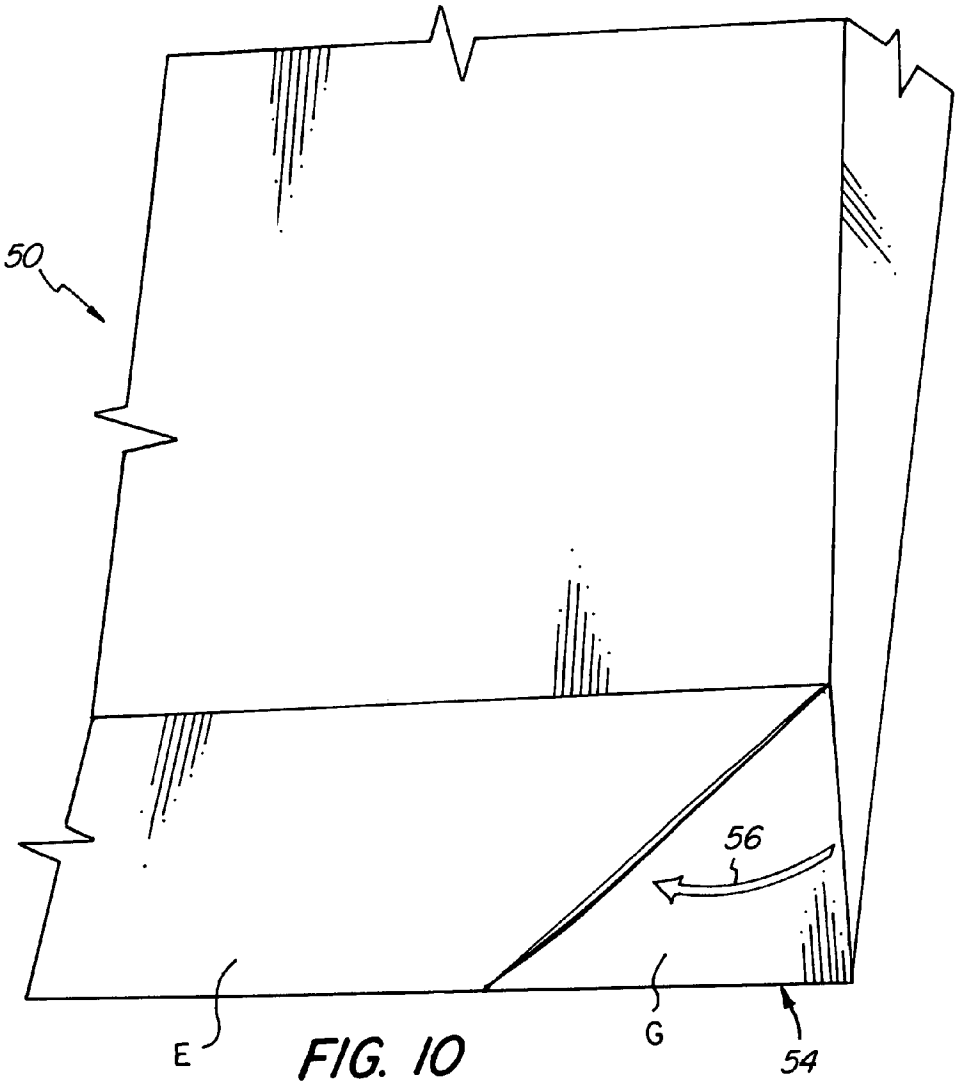
FIG. 10 is a partial bottom view of the tablecloth according to FIG. 9 illustrating a further fold of the corner for binding onto an inside drop of the tablecloth.

With reference to FIG. 6 which shows the tablecloth from outside of the tablecloth, the side drops "B" of the tablecloth 50 are first folded backwards along lines "P". Then, each corner area 54 defined by the folding is now inversely folded along line "Q" as shown in FIG. 8. This forms a first drop fold area "C" and a second drop fold area "D" at the corner area 54, each in a triangular shape facing one another. Then, the first and second drop fold areas C and D are bound to each other by a conventional binding method. Typically, binding agents are applied on the areas C and D for the connection thereof. However, other binding methods can also be applied, for example, such as vinyl welding, riveting, sewing, gluing, elastic or hot knifed or sonic welding, heat formed connection, and Velcro-type connection, etc. After binding of the areas C and D, binding agents are similarly applied to an opposite side of the corner area 54, i.e., on the left inside drop fold area F (shown FIGS. 7 and 8). Then, the combined corner 54 is folded toward a direction 56, and the drop fold area F is bound to the inside drop E as shown in FIG. 10. Alternately, the corner 54 can be folded in an opposite direction (i.e., inversely to the direction 56) and bound onto the other side of drop E, with binding agents previously applied there-about.

The above-described folding and binding is repeated on all four sides. To facilitate the folding of the corners, boundary identification lines "P" and "Q" can be printed in advance on the tablecloth 50, preferably with ink or in pressed or embedded lines. Finished exterior corners illustrate only the areas A and B as finished corners when seen from the outside. This finished process creates a monolithic table covering for fitting over a tabletop.

The following are letter keys for use in reference with FIGS. 6-10:

For 3" Drop fold—

A: Top cover=24"×48"/72"196"

B: Outside drop

C: Outside drop fold/left

D: Outside drop fold/right

E: Inside drop

F: Inside drop fold/left

G: Inside drop fold/right

Where, C is fused to D; and F is fused to E.

Figure 1:
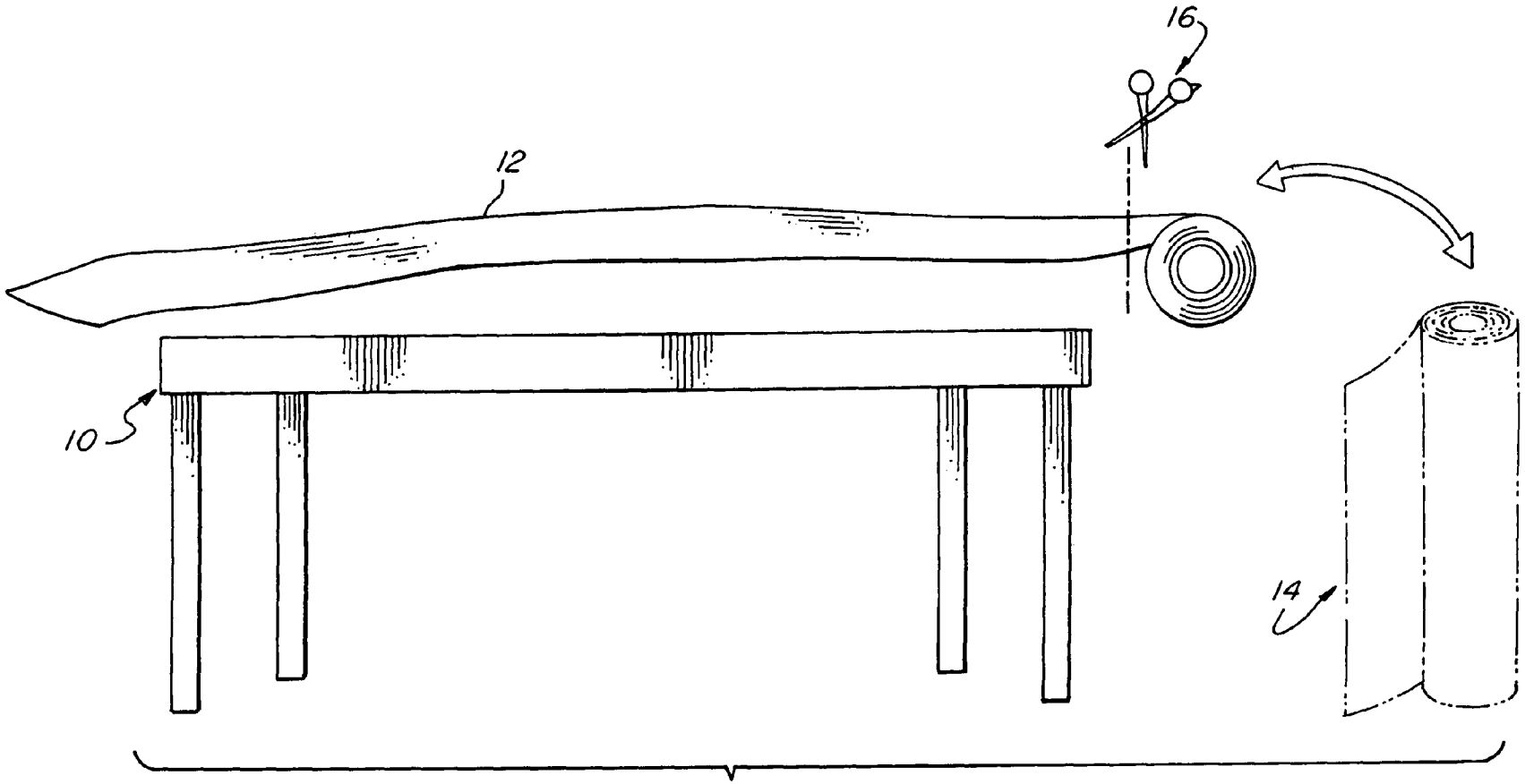
FIG. 1 (PRIOR ART)
FIG. 1 illustrates installation of a tablecloth covering according to a method known in the prior art.
Figure 2:
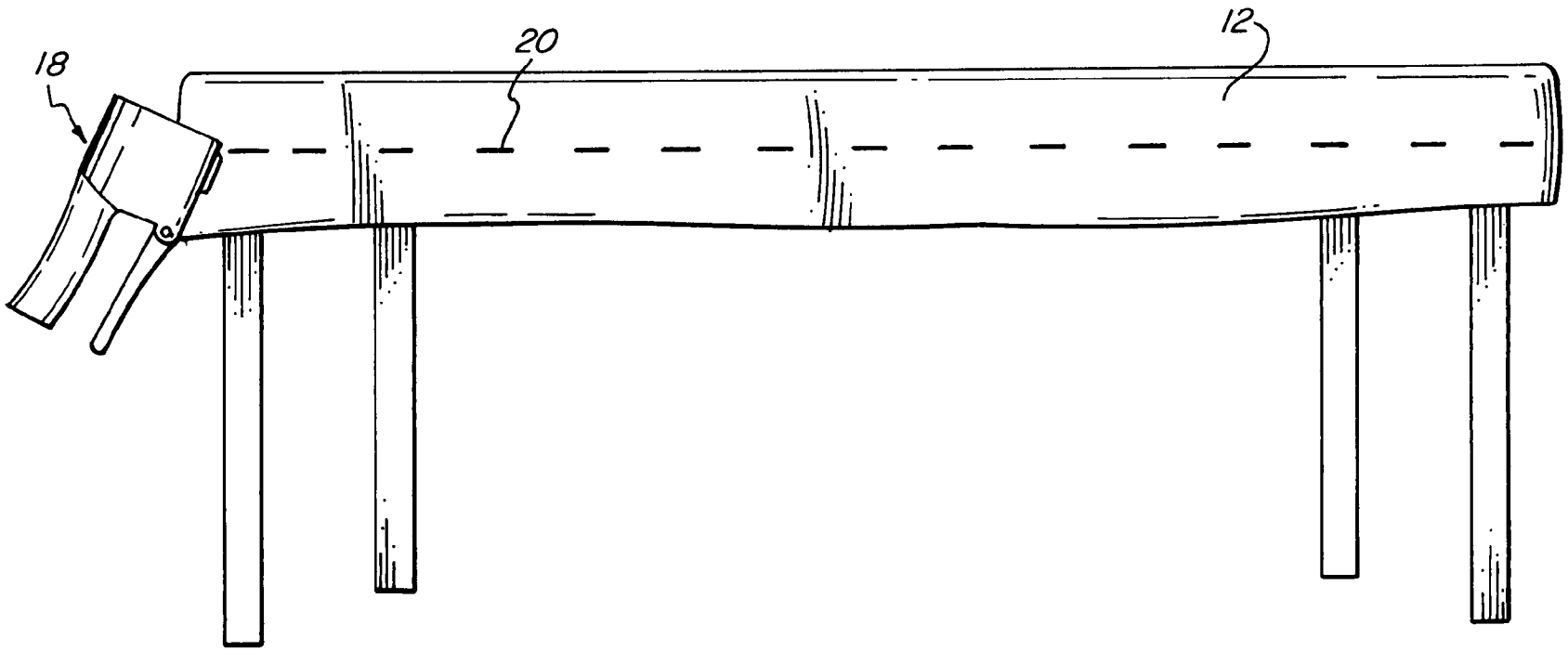
FIG. 2 (PRIOR ART)
FIG. 2 illustrates installation of the tablecloth covering of FIG. 1, showing the tablecloth being stapled to the side of the table.
Figure 3:
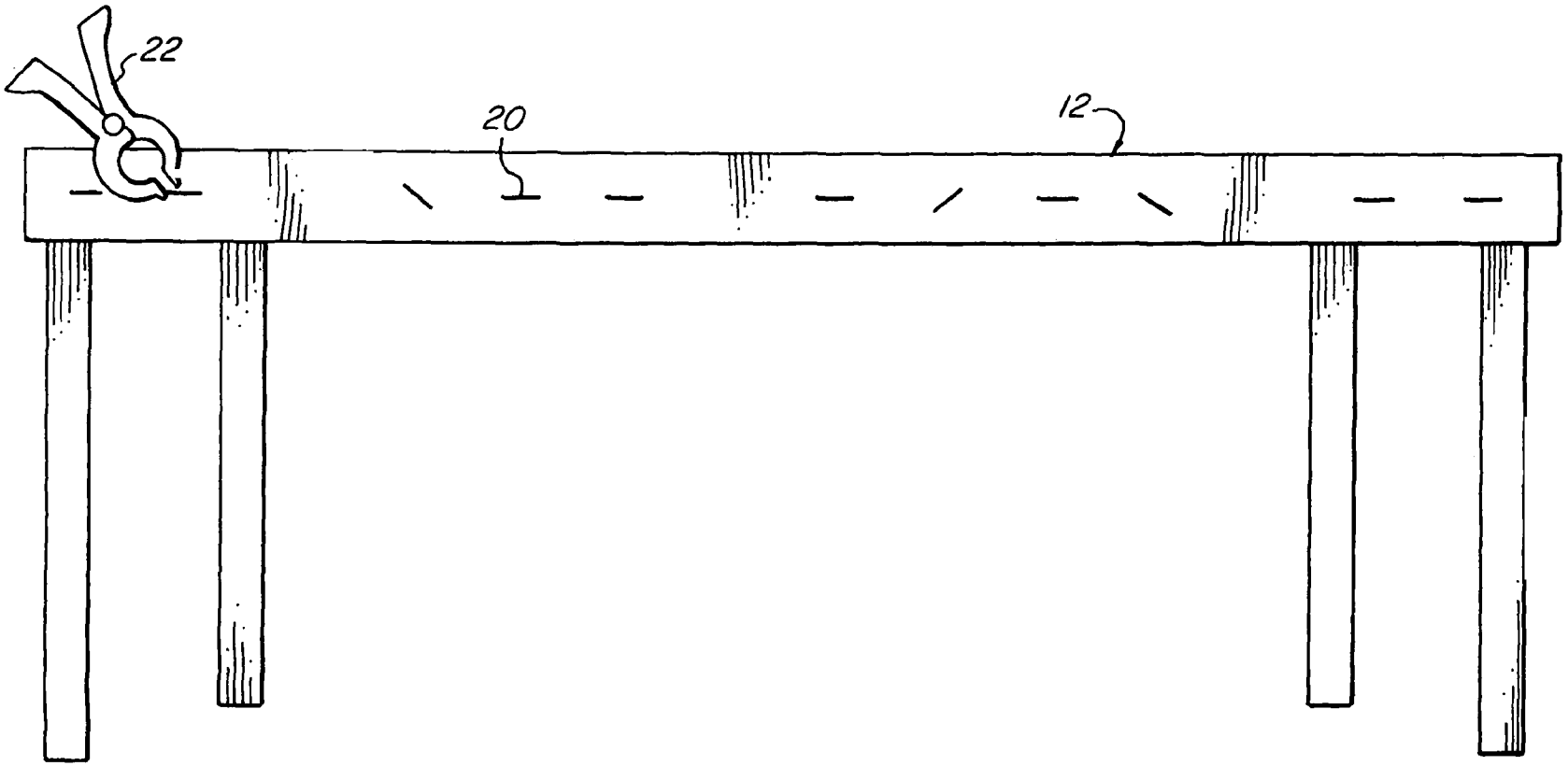
FIG. 3 (PRIOR ART)
FIG. 3 illustrates removal of the staples according to the prior art.
Figure 4A:
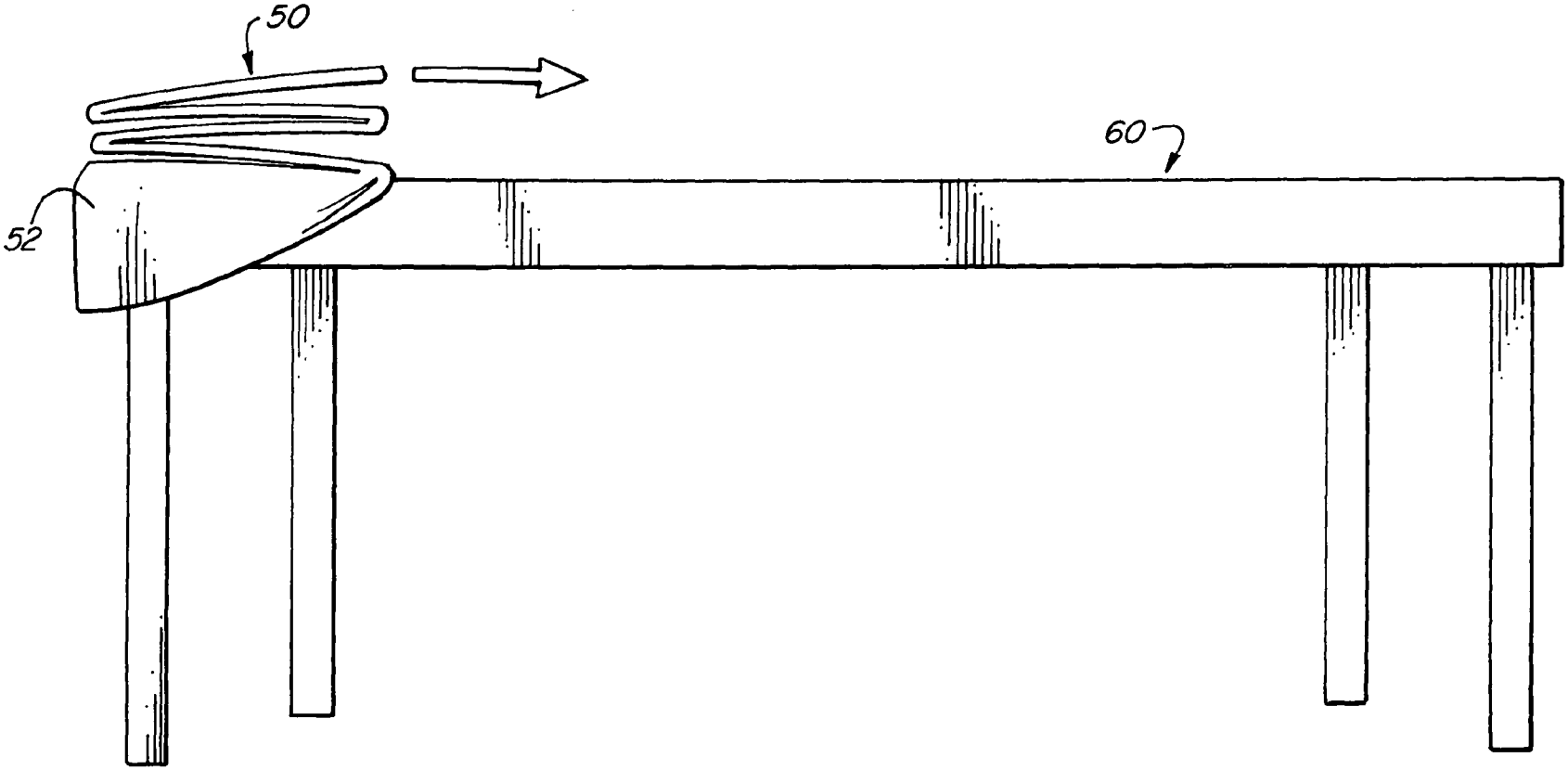
FIG. 4A is an illustration of one preferred embodiment of the present invention showing the tablecloth being initially applied to one end of the table.
Figure 4B:
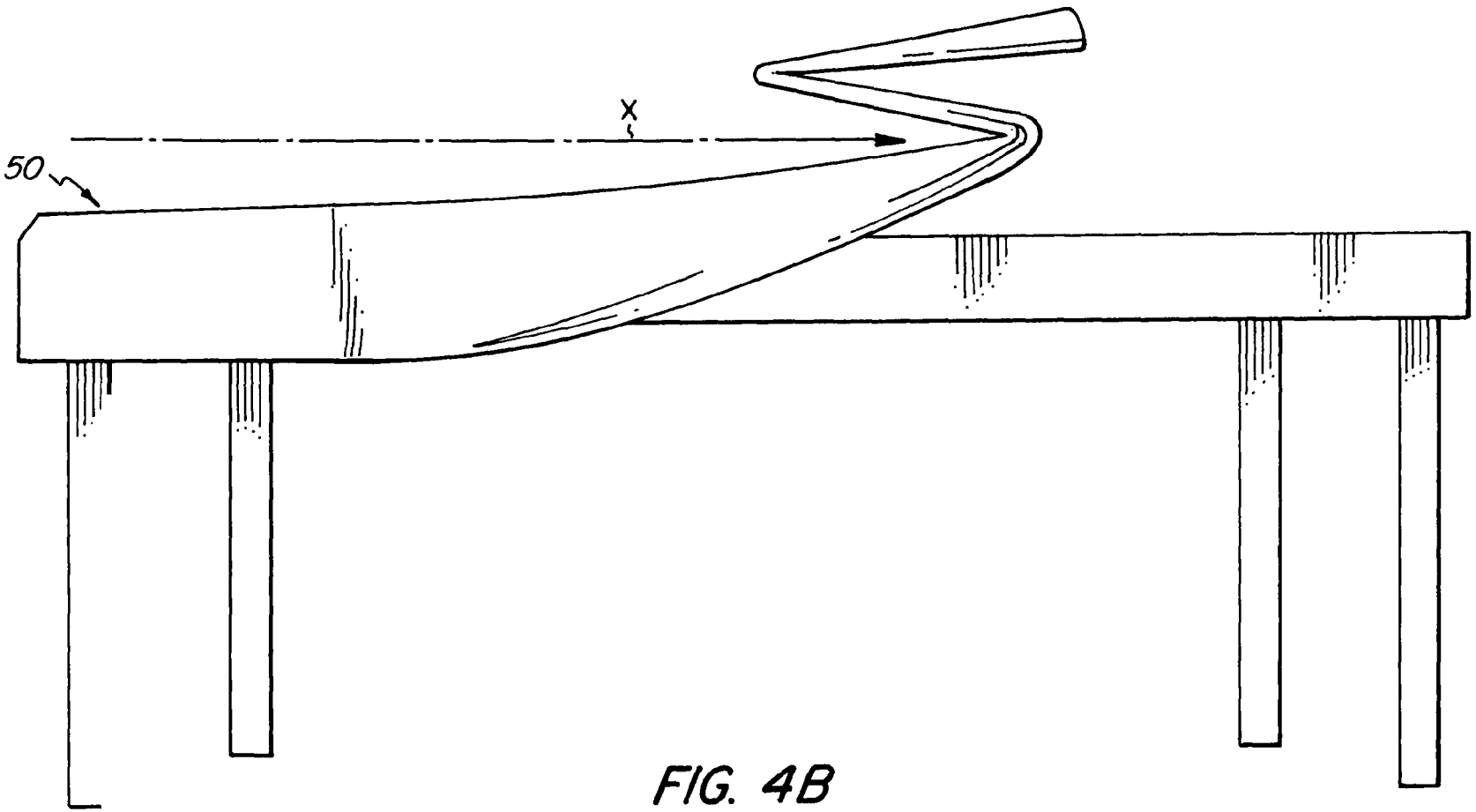
FIG. 4B is an illustration of one preferred embodiment of the present invention according to FIG. 4A, showing the tablecloth being drawn across to the table.
Figure 4C:
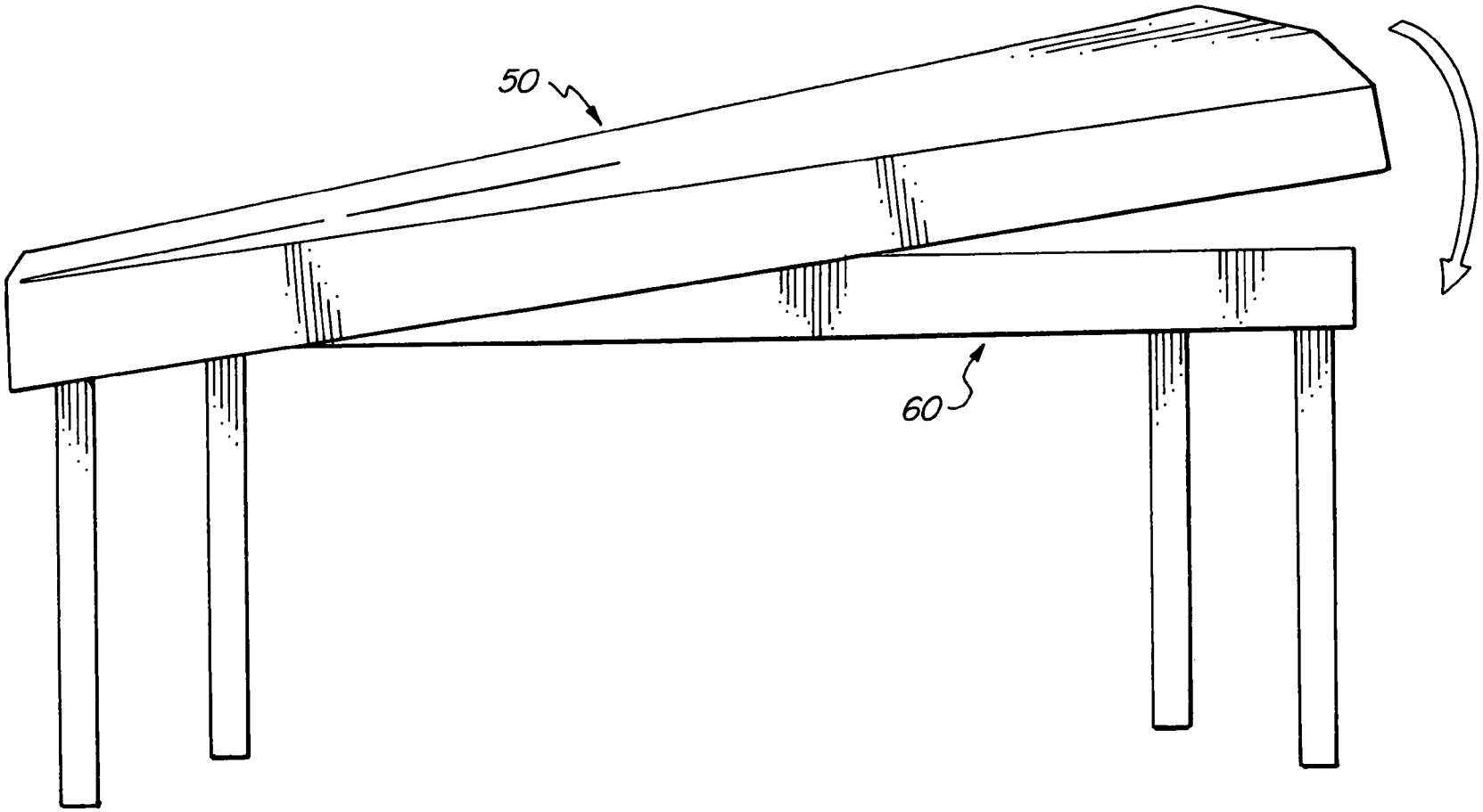
FIG. 4C is an illustration of one preferred embodiment of the present invention according to FIG. 4A, showing the tablecloth being applied over an opposite end of the table.
Figure 4D:
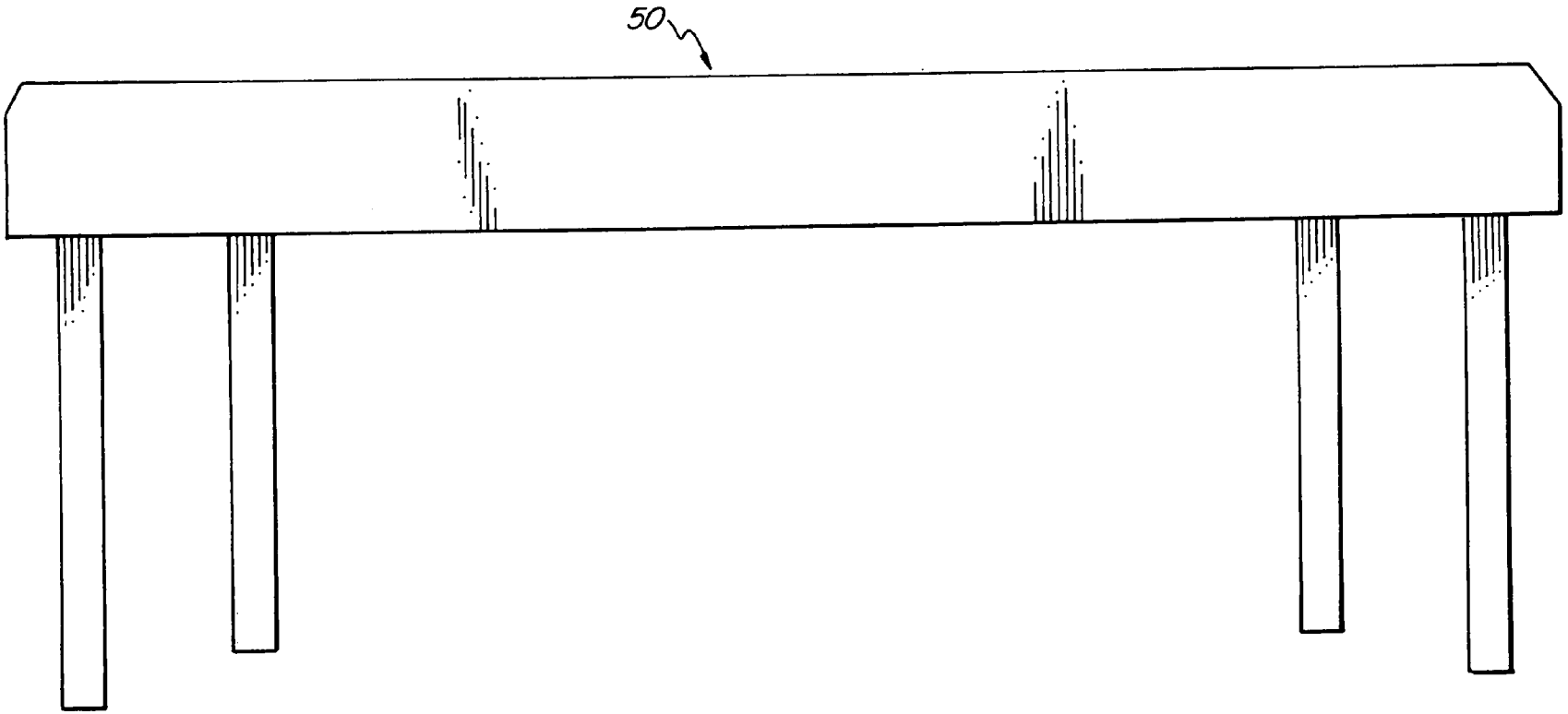
FIG. 4D is an illustration of one preferred embodiment of the present invention according to FIG. 4A, showing the tablecloth applied to the table.

In accordance with one preferred embodiment of the invention, application of the tablecloth or table cover is described herein, with reference to FIGS. 4A-4C. Two formed corners 52 of the tablecloth 50 are first locked onto two corresponding corners on one lateral side of the tabletop 60, as shown in FIG. 4A. Then, the tablecloth 50 is drawn across the corners on the opposite sides of the table, as indicated by arrow "X" in FIG. 4B. Now, the resilient material 50 is pulled and stretched a little, and the rest two formed corners of the tablecloth 50 are locked onto two corresponding corners of the table as shown in FIG. 4C, thus allowing for a custom "fitted" top. Here, in order to prevent development of wrinkles on the fitted tablecloth 50, the resilient tablecloth 50 is to be adequately pulled and smoothed by the hands or with the aid of a ruler or a straight bar. The tablecloth 50 covers the top of the table as well as the lip around the four sides as shown in FIG. 4D.

Such tables with their tabletops 60 covered by the resilient tablecloth 50 can be used, for example, as trade show tables. However, in accordance with another preferred embodiment of the invention as described herein below, the tables can be preferably covered by additional skirts around the side areas of the table.

Figure 11:
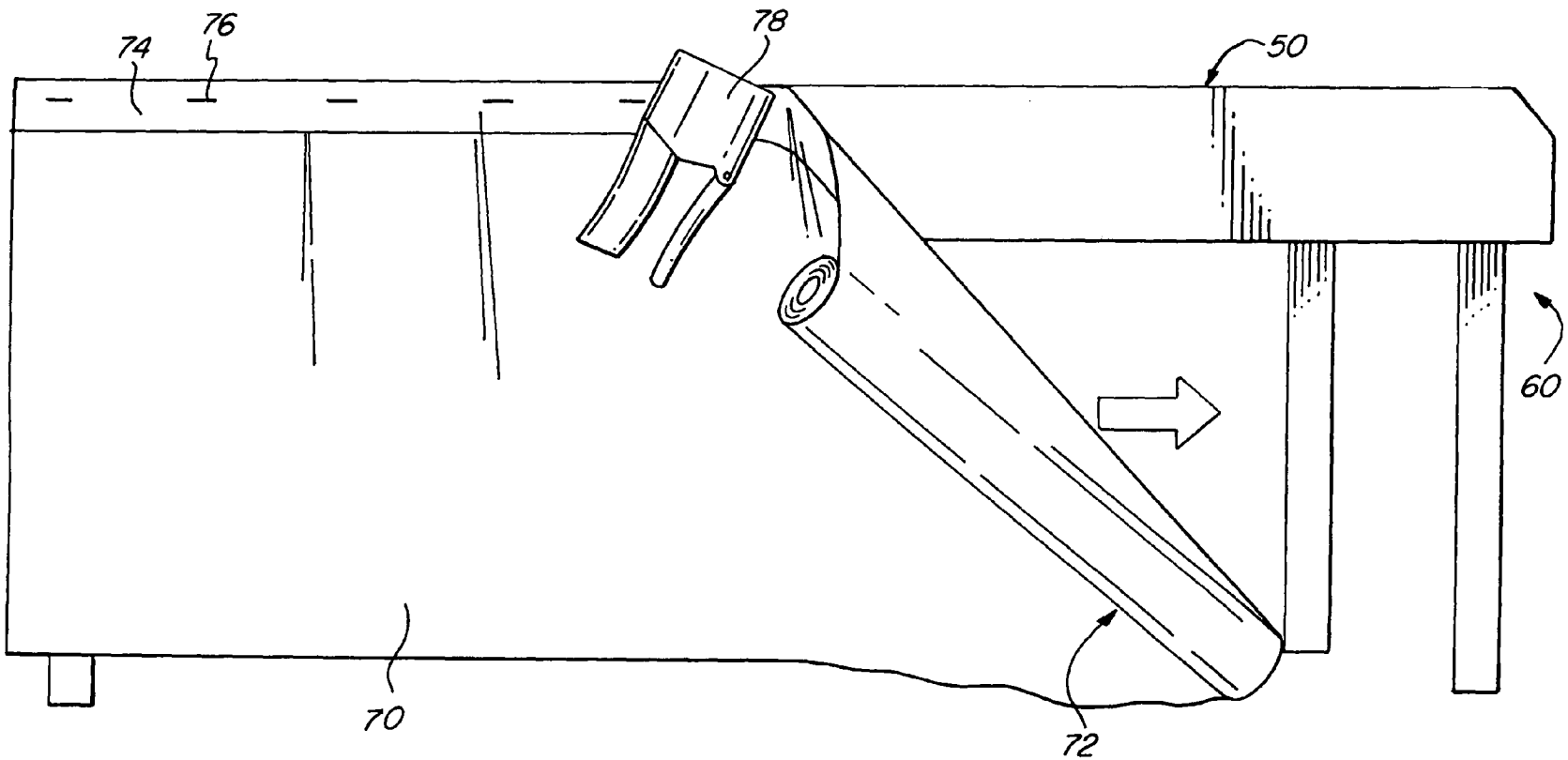
FIG. 11 is a perspective view of one preferred embodiment of the present invention, illustrating application of a skirt along the sides of the tabletop on top of the covered tablecloth.

With reference now to FIG. 11, application of side skirts onto the covered table is described herein. Skirt 70 is preferably formed of fabric or a similar material which is tougher than the resilient tablecloth material. The skirt 70 has a width for suitably covering the sides of the table, and is provided in a roll 72. The skirt 70 may include a reinforced band 74 around the top area of the skirt. The band 74 is similarly formed of a fabric-like material and can provide a tougher foundation for applying staples or tacks, as will be described herein below.

A free end of the rolled skirt 70 is first affixed onto a side of the tabletop 60 with staples 76 applied along the side of the tabletop 60 by using a suitable staple applicator 78. Instead of applying staples 76, other known fasteners such as pins, tacks, or the like can be applied either by hands or using an applicator known in the art. The remaining portion of the skirt 70 is now adequately placed onto the sides of the tabletop 60 and affixed there-around in a similar way. During installation of the skirt 70, the tablecloth may be further pulled tight to remove wrinkles. Also, it is advantageous to apply the fasteners (such as staples, tacks, or pins) onto the reinforced band 74 because it can more securely hold the staples or the like. Accordingly, covered tables of appealing appearance can be provided for using, for example, in a trade show.

One preferred method for disassembly of the coverings (i.e., the skirt 70 and the tablecloth 50) is now described. First, one end side of the fabric skirt 70, which is affixed onto the tabletop 60 by staples 76, is pulled for disassembly. Since the skirt is formed of a fabric material and preferably reinforced with the band 74, this pulling action causes the corresponding portions of the fabric skirt 70 and the staples 76 to be detached from the tabletop 60 without damaging the skirt 70 and the tablecloth 50. The remaining portion of the skirt 70 is then pulled to complete the disassembly of the skirt and the staples (or tacks).

Now, the tablecloth 50 is peeled off from the tabletop 60 in a reverse order to that of the application of the tablecloth as described above, and this completes the disassembly process. The tablecloth 50 removed from the tabletop 60 is typically discarded. However, since the removed tablecloth 50 my not be damaged, it can be reused for a later trade show.

Although the invention has been described with reference to particular ingredients and formulations and the like, these are not intended to exhaust all possible arrangements or features, and indeed many other modifications and variations will be ascertainable to those of skill in the art. For example, the tablecloth of the invention may have a hexagonal (or other polygonal) shape, as described above, for accommodating with a similarly shaped tabletop. Then, its drop fold areas may have a different shape other than that described above to adequately fold and bind to an adjacent side drop.

What is claimed is:

1. A table cover for covering a tabletop of pre-determined size and having a top surface and a plurality of sides, the table cover comprising:

a top cover formed of a polymeric film for covering the top surface of the tabletop, the top cover having a generally polygonal contour with a plurality of sides at its outer periphery thereof;

a plurality of side drops formed of the polymeric film, each extending outwardly from a respective one of the sides of the top cover and being folded generally orthogonal to the top cover to extend downwardly to a free edge;

a plurality of pre-fitted corners, each corner defined by two adjacent side drops permanently joined together along abutting ends thereof to cause the polymeric film to be fitted about the plurality of sides of the tabletop and hold the table cover on the tabletop;

wherein the free edges of the plurality of side drops and the plurality of pre-fitted corners together define a generally polygonal contour having a shape and dimensions substantially identical to a shape and dimensions of the generally polygonal contour of the top cover; and wherein the table cover is monolithic and consists essentially of a single piece of thin vinyl.

2. The table cover of claim 1, wherein the two adjacent sides drops are joined by binding agents.

3. The table cover of claim 1, wherein the two adjacent sides drops are joined by sewing or application of heat.

4. The table cover of claim 1, wherein the table cover is a trade show tablecloth.

5. The table cover of claim 1, wherein the tabletop of predetermined size has a width of about 24 inches and a length selected from the group consisting of about 4 feet, about 6 feet and about 8 feet.

6. The table cover of claim 1, wherein the tabletop has a lip extending downwardly from the sides to define a thickness of the tabletop.

7. The table cover of claim 6, wherein the thickness is about 2½ inches.

8. A table cover for covering a tradeshow table of predetermined size and having a top surface and a plurality of sides and a lip extending downwardly from the sides defining a thickness of the table, the table cover comprising:

a top cover formed of a polymeric film for covering the top surface of the tradeshow table, the top cover including a plurality of sides at its outer periphery thereof;

a plurality of side drops formed of the polymeric film, each of the side drops extending outwards from the respective one of the sides of the top cover, each being folded generally orthogonal to the top cover to extend downwardly alongside the lip to a free edge;

a plurality of pre-fitted corners, each corner defined by two adjacent side drops permanently joined together along abutting ends thereof to cause the polymeric film to be fitted about the sides and lip of the table, and hold the table cover on the table;

wherein the free edges of the plurality of side drops and the plurality of pre-fitted corners together define an outer periphery having a shape and dimensions substantially identical to a shape and dimensions of the outer periphery of the top cover; and wherein the table cover is monolithic and consists essentially of a single piece of thin vinyl.

9. A covered table for use in a trade show comprising:

a tabletop of pre-determined size and having a top surface and a plurality of sides; and a table cover for covering the tabletop, the table cover formed of a polymeric film and comprising:

a top cover having a generally polygonal periphery with a plurality of sides;

a plurality of side drops, each extending outwardly from a respective one of the sides of the top cover and being folded generally orthogonal to the top cover to extend downwardly to a free edge, a plurality of pre-fitted corners, each corner defined by two adjacent side drops permanently joined together along abutting ends thereof to cause the polymeric film to be fitted about the sides of the tabletop and to hold the table cover on the tabletop;

wherein the free edges of the plurality of side drops and the plurality of pre-fitted corners together define a generally polygonal periphery having a shape and dimensions substantially identical to a shape and dimensions of the generally polygonal periphery of the top cover; and wherein the table cover is monolithic and consists essentially of a single piece of thin vinyl.

10. The table of claim 9 further including a skirt attached around the sides of the tabletop on top of the fitted sides of the table cover.

11. The table of claim 10, wherein the skirt is formed of fabric.

12. The table of claim 11, wherein the skirt is attached to the sides of the tabletop by a plurality of staples, tacks, or pins.

13. The table of claim 12, wherein the fabric skirt includes a reinforced band portion at an upper area thereof, and the skirt is attached to the tabletop by a plurality of staples, tacks, or pins applied at the reinforced band portion.

14. The table of claim 10, wherein the table cover is removable and disposable.

15. A method of making a table cover for covering a tabletop of pre-determined size and having a top surface and a plurality of sides, comprising:

providing a top cover formed of a polymeric film for covering the top surface of the tabletop, the top cover having a plurality of sides at its outer periphery and a plurality of side drops, each extending outwardly from a respective one of the sides of the top cover;

folding each of the plurality of sides generally orthogonal to the top cover to extend downwardly to a free edge;

joining together each two adjacent side drops permanently along abutting ends thereof to form a plurality of pre-fitted corners to cause polymeric film to be fitted about the plurality of sides of the tabletop and hold the table cover on the tabletop;

wherein the free edges of the plurality of side drops and the plurality of pre-fitted corners together define an outer periphery having a shape and dimensions substantially identical to a shape and dimensions of the outer periphery of the top cover; and wherein the table cover is monolithic and consists essentially of a single piece of thin vinyl.

16. The method of claim 15 further comprising the step of applying binding agents to each of the two adjacent side drops joined together in forming the pre-fitted corners.

17. The method of claim 15, further comprising the step of sewing together each of the two adjacent side drops joined together in forming the pre-fitted corners.

18. The method of claim 15, further comprising the step of applying heat to each of the two adjacent side drops joined together in forming the pre-fitted corners.

19. A method of placing a table cover over a tabletop of predetermined size and having a top surface and a plurality of sides, comprising:

providing a table cover formed of a polymeric film and having a top cover for covering the top surface of the tabletop, the top cover having a generally polygonal contour with a plurality of sides at its outer periphery thereof, a plurality of side drops, each extending outwardly from a respective one of the sides of the top cover and being folded generally orthogonal to the top cover to extend downwardly to a free edge, and a plurality of pre-fitted corners, each corner defined by two adjacent side drops permanently joined together along abutting ends thereof to cause the polymeric film to be fitted about the plurality of sides of the tabletop and hold the table cover on the tabletop, wherein the free edges of the plurality of side drops and the plurality of pre-fitted corners together define a generally polygonal contour having a shape and dimensions substantially identical to a shape and dimensions of the generally polygonal contour of the top cover, and wherein the table cover is monolithic and consists essentially of a single piece of thin vinyl;

fitting at least two of the pre-fitted corners of the table cover onto corresponding corners of the tabletop;

pulling and extending the table cover across over opposite corners of the tabletop; and fitting the rest of the pre-fitted corners of the table cover onto corresponding corners of the tabletop such that the trade show table is covered and ready for use.

20. The method of claim 19, further comprising the step of removing and disposing of the table cover after use.

21. A method of covering trade show tables each with a tabletop of predetermined size and having a top surface and a plurality of sides, the method comprising:

providing at least one table cover formed of a polymeric film and having a top cover for covering the top surface of the tabletop, the top cover having a generally polygonal contour with a plurality of sides at its outer periphery thereof, a plurality of side drops, each extending outwardly from a respective one of the sides of the top cover and being folded generally orthogonal to the top cover to extend downwardly to form a free edge, and a plurality of pre-formed corners, each corner defined by two adjacent side drops permanently joined together along abutting ends thereof to cause the polymeric film to be fitted about the plurality of sides of the tabletop and hold the table cover on the tabletop, wherein the free edges of the plurality of side drops and the plurality of pre-fitted corners together define a generally polygonal contour having a shape and dimensions substantially identical to a shape and dimensions of the generally polygonal contour of the top cover, and wherein the table cover is monolithic and consists essentially of a single piece of thin vinyl;

fitting at least two of the pre-fitted corners of the table cover onto corresponding corners of the tabletop;

pulling and extending the table cover across over opposite corners of the tabletop;

fitting the rest of the pre-fitted corners of the table cover onto corresponding corners of the tabletop to hold the table cover on the trade show table;

providing at least one skirt, each formed of a fabric material and dimensioned to cover side areas of the respective table; and attaching the skirt around the tabletop on top of the fitted sides of the table cover of each respective trade show table.

22. The method of claim 21, further comprising the steps of:

removing and disposing of the table cover after use; and placing a new table cover on the table top.

23. The method of claim 21, wherein the attaching of the skirt is performed by applying a plurality of staples, tacks, or pins along the sides of the tabletop.

24. The method of claim 23 further comprising the steps of:

detaching the fabric skirt and the plurality of staples, tacks, or pins attached to the fabric skirt;

removing the fitted table cover from the tabletop; and disposing of the table cover.

25. The method of claim 24 further comprising the step of applying a new table cover to each of the trade show tables.

26. A table cover for covering a generally rectangular table of pre-determined size comprising:

a top cover formed from a polymeric film having four edges defining a length and a width;

four sides formed from the polymeric film, each extending outwardly from a respective one of the edges of the top cover and bent down at an angle of about 90° from the top cover such that the four sides together define a length and a width that is substantially the same as the length and the width of the top cover, and each of the four sides having a free edge opposite to a respective edge of the top cover and two edges orthogonal to the top surface; and wherein the table cover is monolithic and consists essentially of a single piece of thin vinyl.

27. A table cover for covering a generally polygonal table of pre-determined size comprising:

a top cover formed from a polymeric film having edges defining a periphery having a shape and a size;

a plurality of sides formed from the polymeric film, each extending outwardly from a respective one of the edges of the top cover and bent down at an angle of about 90° from the top cover such that the plurality of sides together define a shape and a size that is substantially the same as the shape and the size of the periphery of the top cover, and each of the plurality of sides having a free edge opposite to a respective edge of the top cover and two edges orthogonal to the top surface; and wherein the table cover is monolithic and consists essentially of a single piece of thin vinyl.

* * * * *